US011626071B2

(12) United States Patent
Wang et al.

(10) Patent No.: US 11,626,071 B2
(45) Date of Patent: Apr. 11, 2023

(54) PIXEL DRIVING CIRCUIT AND DISPLAY PANEL CONFIGURED TO DETECT FIRST AND SECOND THRESHOLD VOLTAGES OF A DRIVING MODULE

(71) Applicant: SHENZHEN CHINA STAR OPTOELECTRONICS SEMICONDUCTOR DISPLAY TECHNOLOGY CO., LTD., Shenzhen (CN)

(72) Inventors: Limin Wang, Shenzhen (CN); Taijiun Hwang, Shenzhen (CN); Zhenling Wang, Shenzhen (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 421 days.

(21) Appl. No.: 16/760,494

(22) PCT Filed: Apr. 21, 2020

(86) PCT No.: PCT/CN2020/085950
§ 371 (c)(1),
(2) Date: Apr. 30, 2020

(87) PCT Pub. No.: WO2021/203479
PCT Pub. Date: Oct. 14, 2021

(65) Prior Publication Data
US 2022/0319430 A1 Oct. 6, 2022

(30) Foreign Application Priority Data
Apr. 8, 2020 (CN) ..... 202010269302.4

(51) Int. Cl.
*G09G 3/3258* (2016.01)
*G09G 3/00* (2006.01)
*G09G 3/3291* (2016.01)

(52) U.S. Cl.
CPC ..... *G09G 3/3258* (2013.01); *G09G 3/006* (2013.01); *G09G 3/3291* (2013.01);
(Continued)

(58) Field of Classification Search
None
See application file for complete search history.

(56) References Cited

U.S. PATENT DOCUMENTS 10,600,356 B1 3/2020 Lee
2015/0022429 A1* 1/2015 Chae ..... G09G 3/3291 345/82

(Continued)

FOREIGN PATENT DOCUMENTS

CN 106531074 A 3/2017
CN 106710528 A 5/2017

(Continued)

*Primary Examiner* — Kirk W Hermann
(74) *Attorney, Agent, or Firm* — PV IP PC; Wei Te Chung; Ude Lu

(57) ABSTRACT

In the pixel driving circuit, a cathode of a light-emitting device is connected to an output terminal of a driving module; during a first detection period, an anode of the light-emitting device is connected to a low electrical potential power signal; during a second detection period and a display period, the anode of the light-emitting device is connected to a high electrical potential power signal; and in a light-emitting phase of the display period, voltage values of the output terminals of the driving module are all within a preset range in the pixel driving circuit corresponding to different sub-pixels.

17 Claims, 8 Drawing Sheets

(52) U.S. Cl.
CPC ..... *G09G 2300/0842* (2013.01); *G09G 2320/0233* (2013.01); *G09G 2330/12* (2013.01)

(56) References Cited

U.S. PATENT DOCUMENTS

| | | | | |
|---|---|---|---|---|
| 2015/0154908 | A1* | 6/2015 | Nam | G09G 3/3233 345/76 |
| 2016/0146861 | A1* | 5/2016 | Min | G06F 11/2284 324/96 |
| 2018/0268760 | A1* | 9/2018 | Chen | G09G 3/3266 |
| 2020/0286426 | A1* | 9/2020 | Li | H01L 27/3276 |

FOREIGN PATENT DOCUMENTS

| | | | | |
|---|---|---|---|---|
| CN | 109686312 | A | | 4/2019 |
| CN | 110197647 | A | | 9/2019 |
| KR | 20160056234 | A | * | 5/2016 |
| KR | 1020180060594 | | * | 6/2018 |
| KR | 20150061548 | A | * | 6/2020 |
| KR | 20200025938 | A | * | 3/2022 |

* cited by examiner

PIXEL DRIVING CIRCUIT AND DISPLAY PANEL CONFIGURED TO DETECT FIRST AND SECOND THRESHOLD VOLTAGES OF A DRIVING MODULE

FIELD OF INVENTION

The present disclosure relates to the field of display technology, and more particularly, to a pixel driving circuit and a display panel.

BACKGROUND OF INVENTION

Among current OLED or inverted-LED display panels, a cathode of each light-emitting device corresponding to each sub-pixel is respectively connected to a low electrical potential power signal VSS, and an anode of each light-emitting device corresponding to each subpixel is respectively connected to a 3T1C pixel driving circuit. A plurality of driver transistors of the pixel driving circuit is configured to drive the light-emitting device to emit light, and due to various reasons, a threshold voltage Vth of the driver transistors may drift. Therefore, the prior art usually comprehensively compensates the threshold voltage Vth of the driver transistor during a first detection period between power-on or after power-off and a second detection period between adjacent display frames. However, the cathodes of the light-emitting devices at different positions on the panel have different distances to an input terminal of the low electrical potential power signal VSS, and a voltage of the cathode farther from the input terminal is less than a voltage of the cathode closer to the input terminal, which causes a power supply voltage drop (IR-Drop) phenomenon and leads to a voltage difference between the cathode and anode of different light-emitting devices. The farther away from the input terminal, the less the voltage difference is, ultimately leading to uneven brightness of display screen.

Therefore, current display panels have a technical problem of uneven brightness of the screen, which needs to be solved.

SUMMARY OF INVENTION

The present disclosure provides a pixel driving circuit and a display panel to improve the technical problem of uneven brightness of display screen of current display panels.

To solve the above problems, the technical solutions provided by the present disclosure are as follows:

An embodiment of the present disclosure provides a pixel driving circuit, including:

a data signal input module configured to input a first data signal to a first point under control of a first control signal in a first detection period, wherein the first detection period is a non-display period before turning on or after turning off;

a light-emitting device, wherein an anode of the light-emitting device is connected to a first power signal input terminal;

a driving module, wherein a first input terminal of the driving module is connected to the data signal input module through the first point, a second input terminal of the driving module is connected to a second power signal input terminal, and an output terminal of the driving module is connected to a cathode of the light-emitting device, and wherein the driving module is configured to drive the light-emitting device to emit light under control of a second control signal and an electric potential of the first point;

a detection module connected to a third input terminal of the driving module through a second point, connected to the output terminal of the driving module through a third point, configured to detect a first threshold voltage of the driving module under a control of a third control signal during the first detection period, and configured to detect a second threshold voltage of the driving module under a control of a fourth control signal during a second detection period, wherein the second detection period is a blank period between adjacent display frames; and a storage module connected to the driving module through the first point and the second point, and configured to store the first threshold voltage and the second threshold voltage of the driving module;

wherein the data signal input module is further configured to input a compensated second data signal to the first point during a data writing phase of a display period according to the first threshold voltage detected by the detection module, the driving module is further configured to input a driving current to the light-emitting device during a light-emitting phase of the display period according to the second data signal and the second threshold voltage detected by the detection module, wherein the driving current is independent of values of the first threshold voltage and the second threshold voltage, and wherein during the first detection period, the first power signal input terminal is connected to a low electrical potential power signal, and the second power signal input terminal is connected to a high electrical potential power signal, during the second detection period and the display period, the first power signal input terminal is connected to the high electrical potential power signal, and the second power signal input terminal is connected to the low electrical potential power signal, and in the light-emitting phase of the display period, voltage values of the output terminals of the driving modules are all within a preset range in the pixel driving circuits corresponding to different sub-pixels.

In the pixel driving circuit of the present disclosure, the data signal input module comprises a first transistor, a gate of the first transistor is connected to the first control signal, a first electrode of the first transistor is connected to a data line, and a second electrode of the first transistor is connected to the first point.

In the pixel driving circuit of the present disclosure, the light-emitting device comprises a light-emitting diode or an organic light-emitting diode.

In the pixel driving circuit of the present disclosure, the driving module comprises a second transistor and a third transistor, a gate of the second transistor is connected to the first point, a first electrode of the second transistor and a second electrode of the third transistor are connected to the second point, a second electrode of the second transistor and the cathode of the light-emitting device are connected to the third point, a gate of the third transistor is connected to the second control signal, and a first electrode of the third transistor is connected to the second power signal input terminal.

In the pixel driving circuit of the present disclosure, the detection module comprises a first detection transistor, a second detection transistor, a sensing line, and a selection switch, a gate of the first detection transistor is connected to the third control signal, a first electrode of the first detection transistor is connected to the sensing line, a second electrode of the first detection transistor is connected to the third point, a gate of the second detection transistor is connected to the fourth control signal, a first electrode of the second detection transistor is connected to the sensing line, a second electrode of the second detection transistor is connected to the second point, a movable contact point of the selection switch is connected to the sensing line, a first static contact point of the selection switch is connected to a control voltage input terminal, and a second static contact point of the selection switch is connected to an analog-to-digital converter.

In the pixel driving circuit of the present disclosure, the storage module comprises a storage capacitor, a first plate of the storage capacitor is connected to the first point, and a second plate of the storage capacitor is connected to the second point.

In the pixel driving circuit of the present disclosure, during the first detection period, the third control signal is at a high electrical potential and the fourth control signal is at a low electrical potential.

In the pixel driving circuit of the present disclosure, the first detection period comprises an initialization phase, a charging phase, and a first detection phase, and the detection module is configured to: control the movable contact point of the selection switch to be connected to the first static contact point during the initialization phase, control the movable contact point of the selection switch to be disconnected from both the first static contact point and the second static contact point during the charging phase, and control the movable contact point of the selection switch connected to the second static contact point during the first detection phase.

In the pixel driving circuit of the present disclosure, during the initialization phase, the control voltage input terminal is inputted a reference voltage signal.

In the pixel driving circuit of the present disclosure, the second detection period comprises a reset phase and a second detection phase, during the reset phase, the third control signal is at a low electrical potential and the fourth control signal is at a high electrical potential, and during the second detection phase, the third control signal and the fourth control signal are both at the low electrical potential.

In the pixel driving circuit of the present disclosure, the detection module is configured to control the movable contact point of the selection switch to be connected to the first static contact point during the reset phase.

In the pixel driving circuit of the present disclosure, during the reset phase, an initial voltage signal is inputted to the control voltage input terminal.

In the pixel driving circuit of the present disclosure, the data signal input module is configured to input a compensated reference data signal to the first point according to the first threshold voltage detected by the detection module during the second detection phase.

In the pixel driving circuit of the present disclosure, during the display period, the third control signal and the fourth control signal are both at a low electrical potential.

The present disclosure also provides a display panel including a pixel driving circuit, wherein the pixel driving circuit including: a data signal input module configured to input a first data signal to a first point under control of a first control signal in a first detection period, wherein first detection period is a non-display period before turning on or after turning off;

a light-emitting device, wherein an anode of the light-emitting device is connected to a first power signal input terminal;

a driving module, wherein a first input terminal of the driving module is connected to the data signal input module through the first point, a second input terminal of the driving module is connected to a second power signal input terminal, and an output terminal of the driving module is connected to a cathode of the light-emitting device, and wherein the driving module is configured to drive the light-emitting device to emit light under control of a second control signal and an electric potential of the first point;

a detection module connected to a third input terminal of the driving module through a second point, connected to the output terminal of the driving module through a third point, configured to detect a first threshold voltage of the driving module under a control of a third control signal during the first detection period; and configured to detect a second threshold voltage of the driving module under a control of a fourth control signal during a second detection period, wherein the second detection period is a blank period between adjacent display frames; and a storage module connected to the driving module through the first point and the second point, and configured to store the first threshold voltage and the second threshold voltage of the driving module;

wherein the data signal input module is further configured to input a compensated second data signal to the first point during a data writing phase of a display period according to the first threshold voltage detected by the detection module, the driving module is further configured to input a driving current to the light-emitting device during a light-emitting phase of the display period according to the second data signal and the second threshold voltage detected by the detection module, wherein the driving current is independent of values of the first threshold voltage and the second threshold voltage, and wherein during the first detection period, the first power signal input terminal is connected to a low electrical potential power signal, and the second power signal input terminal is connected to a high electrical potential power signal, during the second detection period and the display period, the first power signal input terminal is connected to the high electrical potential power signal, and the second power signal input terminal is connected to the low electrical potential power signal, and in the light-emitting phase of the display period, voltage values of the output terminals of the driving modules are all within a preset range in the pixel driving circuits corresponding to different sub-pixels.

In the display panel of the present disclosure, the data signal input module comprises a first transistor, a gate of the first transistor is connected to the first control signal, a first electrode of the first transistor is connected to a data line, and a second electrode of the first transistor is connected to the first point.

In the display panel of the present disclosure, the light-emitting device comprises a light-emitting diode or an organic light-emitting diode.

In the display panel of the present disclosure, the driving module comprises a second transistor and a third transistor, a gate of the second transistor is connected to the first point, a first electrode of the second transistor and a second electrode of the third transistor are connected to the second point, a second electrode of the second transistor and the cathode of the light-emitting device are connected to the third point, a gate of the third transistor is connected to the second control signal, and a first electrode of the third transistor is connected to the second power signal input terminal.

In the display panel of the present disclosure, the detection module comprises a first detection transistor, a second detection transistor, a sensing line, and a selection switch, a gate of the first detection transistor is connected to the third control signal, a first electrode of the first detection transistor is connected to the sensing line, a second electrode of the first detection transistor is connected to the third point, a gate of the second detection transistor is connected to the fourth control signal, a first electrode of the second detection transistor is connected to the sensing line, a second electrode of the second detection transistor is connected to the second point, a movable contact point of the selection switch is connected to the sensing line, a first static contact point of the selection switch is connected to a control voltage input terminal, and a second static contact point of the selection switch is connected to an analog-to-digital converter.

In the display panel of the present disclosure, the storage module comprises a storage capacitor, a first plate of the storage capacitor is connected to the first point, and a second plate of the storage capacitor is connected to the second point.

Beneficial effects of the present disclosure: Embodiments of the present disclosure provide a pixel driving circuit and a display panel, wherein the pixel driving circuit includes a data signal input module, a light-emitting device, a driving module, a detection module, and a storage module. The data signal input module is configured to input a first data signal to a first point under control of a first control signal in a first detection period, wherein the first detection period is a non-display period before turning on or after turning off; an anode of the light-emitting device is connected to a first power signal input terminal; a first input terminal of the driving module is connected to the data signal input module through the first point, a second input terminal of the driving module is connected to a second power signal input terminal, and an output terminal of the driving module is connected to a cathode of the light-emitting device, wherein the driving module is configured to drive the light-emitting device to emit light under control of a second control signal and an electric potential of the first point. The detection module is connected to a third input terminal of the driving module through a second point, connected to the output terminal of the driving module through a third point, configured to detect a first threshold voltage of the driving module under a control of a third control signal during the first detection period, and configured to detect a second threshold voltage of the driving module under a control of a fourth control signal during a second detection period, wherein the second detection period is a blank period between adjacent display frames. The storage module is connected to the driving module through the first point and the second point, and configured to store the first threshold voltage and the second threshold voltage of the driving module, wherein the data signal input module is further configured to input a compensated second data signal to the first point during a data writing phase of a display period according to the first threshold voltage detected by the detection module. The driving module is further configured to input a driving current to the light-emitting device during a light-emitting phase of the display period according to the second data signal and the second threshold voltage detected by the detection module, wherein the driving current is independent of values of the first threshold voltage and the second threshold voltage, and wherein during the first detection period, the first power signal input terminal is connected to a low electrical potential power signal and the second power signal input terminal is connected to a high electrical potential power signal, during the second detection period and the display period, the first power signal input terminal is connected to the high electrical potential power signal and the second power signal input terminal is connected to the low electrical potential power signal, and in the light-emitting phase of the display period, voltage values of the output terminals of the driving modules are all within a preset range in the pixel driving circuits corresponding to different sub-pixels. In the pixel driving circuit of the present disclosure, anodes of all the light-emitting device are connected, cathodes of all the light-emitting device are connected to the output terminal of the driving module, and in the light-emitting phase of the display period, voltage values of the output terminals of the driving modules are all within a preset range in the pixel driving circuits corresponding to different sub-pixels. That is, the voltage values of the cathode of the light-emitting device at different positions of the display panel are within the preset range, so each light-emitting device can be less affected by the power supply voltage drop, therefore improving brightness uniformity of the display panel. Moreover, during the first detection period, the anode of the light-emitting device is connected to the low electrical potential power signal, thereby turning off the light-emitting device directly, preventing electrical leakage of the light-emitting device to the detection module, thereby improving detection accuracy.

DESCRIPTION OF DRAWINGS

In order to more clearly illustrate the embodiments or the technical solutions in the prior art or the embodiment, the figures used in the description of the embodiments or the prior art will be briefly introduced below. Obviously, the figures in the following description are merely some embodiments of the present disclosure, for those of ordinary skill in the art, other figures may be obtained based on these figures without inventive steps.

DETAILED DESCRIPTION OF PREFERRED EMBODIMENTS

Figure 1:
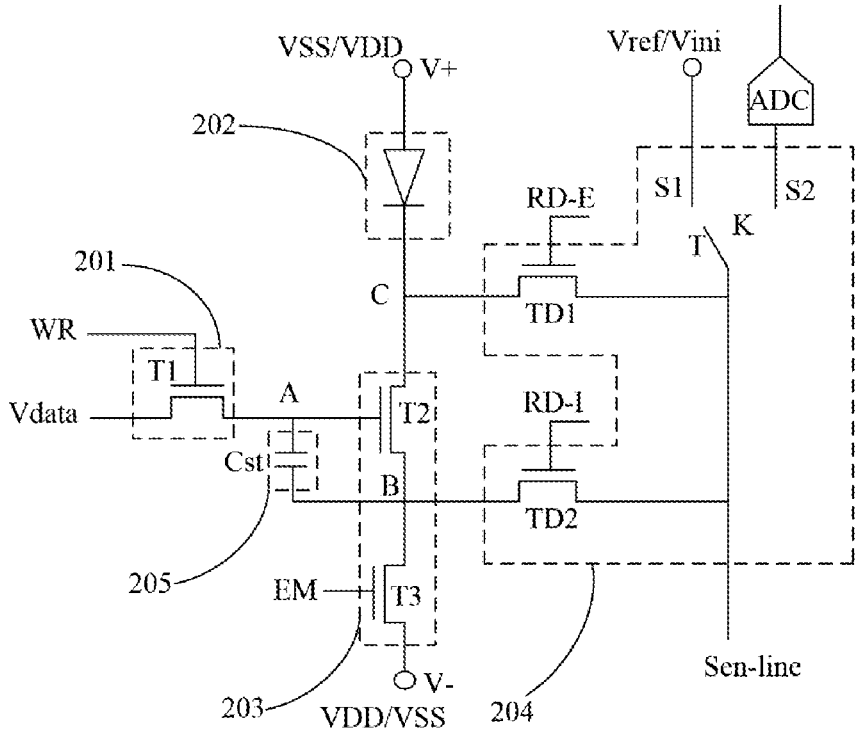
FIG. 1 is a schematic structural diagram of a pixel driving circuit according to one embodiment of the present disclosure.

The following is a description of each embodiment with reference to additional figures to illustrate specific embodiments in which the present disclosure can be implemented. The directional terms mentioned in the present disclosure, such as up, down, front, back, left, right, inside, outside, side, etc., are only directions referring to the figures. Therefore, the directional terms are to explain and understand the disclosure, not to limit it. In the figure, similarly structured units are denoted by the same reference numerals.

Embodiments of the present disclosure provide a pixel driving circuit and a display panel to improve the technical problem of uneven brightness of display screen of current display panels.

As shown in FIG. 1, FIG. 1 is a schematic structural diagram of a pixel driving circuit according to one embodiment of the present disclosure. The pixel driving circuit includes a data signal input module 201, a light-emitting device 202, a driving module 203, a detection module 204, and a storage module 205.

The data signal input module 201 is configured to input a first data signal to a first point A under control of a first control signal WR in a first detection period, wherein the first detection period is a non-display period before turning on or after turning off.

An anode of the light-emitting device 202 is connected to a first power signal input terminal V+.

A first input terminal of the driving module 203 is connected to the data signal input module 201 through the first point A, a second input terminal of the driving module 203 is connected to a second power signal input terminal V−, and an output terminal of the driving module 203 is connected to a cathode of the light-emitting device 202, wherein the driving module 203 is configured to drive the light-emitting device 202 to emit light under control of a second control signal EM and an electric potential of the first point A.

The detection module 204 connected to a third input terminal of the driving module 203 through a second point, connected to the output terminal of the driving module 203 through a third point C, configured to detect a first threshold voltage of the driving module under a control of a third control signal RD-E during the first detection period, and configured to detect a second threshold voltage Vth' of the driving module 203 under a control of a fourth control signal RD-I during a second detection period, wherein the second detection period is a blank period between adjacent display frames.

The storage module 205 connected to the driving module 203 through the first point A and the second point B, and configured to store the first threshold voltage Vth and the second threshold voltage Vth' of the driving module 203.

The data signal input module 201 is further configured to input a compensated second data signal to the first point A during a data writing phase of a display period according to the first threshold voltage Vth detected by the detection module 204, the driving module 203 is further configured to input a driving current to the light-emitting device 202 during a light-emitting phase of the display period according to the second data signal and the second threshold voltage Vth' detected by the detection module 204, wherein the driving current is independent of values of the first threshold voltage Vth and the second threshold voltage Vth', and wherein during the first detection period, the first power signal input terminal V+ is connected to a low electrical potential power signal VSS, and the second power signal input terminal V− is connected to a high electrical potential power signal VDD, during the second detection period and the display period, the first power signal input terminal V+ is connected to the high electrical potential power signal VDD, and the second power signal input terminal V− is connected to the low electrical potential power signal VSS, and in the light-emitting phase of the display period, voltage values of the output terminals of the driving modules 203 are all within a preset range in the pixel driving circuits corresponding to different sub-pixels.

Specifically, the data signal input module 201 includes a first transistor T1, a gate of the first transistor T1 is connected to the first control signal WR, a first electrode of the first transistor T1 is connected to a data line Data, and a second electrode of the first transistor T1 is connected to the first point A.

The light-emitting device 202 includes a light-emitting diode LED or an organic light-emitting diode OLED, wherein the LED is an inverted-LED.

The driving module 203 includes a second transistor T2 and a third transistor T3, a gate of the second transistor T2 is connected to the first point A, a first electrode of the second transistor T2 and a second electrode of the third transistor T3 are connected to the second point B, a second electrode of the second transistor T2 and the cathode of the light-emitting device 202 are connected to the third point C, a gate of the third transistor T3 is connected to the second control signal EM, and a first electrode of the third transistor T3 is connected to the second power signal input terminal V−.

The detection module 204 comprises a first detection transistor TD1, a second detection transistor TD2, a sensing line sen-line, and a selection switch K, a gate of the first detection transistor TD1 is connected to the third control signal RD-E, a first electrode of the first detection transistor TD1 is connected to the sensing line sen-line, a second electrode of the first detection transistor TD1 is connected to the third point C, a gate of the second detection transistor TD2 is connected to the fourth control signal RD-I, a first electrode of the second detection transistor TD2 is connected to the sensing line sen-line, a second electrode of the second detection transistor TD2 is connected to the second point B, a movable contact point T of the selection switch K is connected to the sensing line sen-line, a first static contact point S1 of the selection switch K is connected to a control voltage input terminal, and a second static contact point S2 of the selection switch K is connected to an analog-to-digital converter ADC.

The storage module 205 includes a storage capacitor Cst, a first plate of the storage capacitor Cst is connected to the first point A, and a second plate of the storage capacitor Cst is connected to the second point B.

In the present disclosure, one of the first electrode and the second electrode of each transistor is a source and the other is a drain, a voltage value of the high electrical potential power signal VDD is greater than a voltage value of the low electrical potential power signal VSS, and the data line Data is configured to input data signal Vdata. In the driving module 203, the second transistor T2 is a driver transistor, the first threshold voltage of the driving module 203 is the first threshold voltage Vth of the second transistor T2, and the second threshold voltage of the driving module 203 is the second threshold value of the second transistor T2 Voltage Vth'. Each transistor may be an N-type or a P-type transistor. In the present disclosure, the N-type transistor is used to describe the working principle of the pixel driving circuit during various phases.

In the pixel driving circuit of the present disclosure, during the first detection period which is the non-display period before turning on or after turning off, the threshold voltage of the driving module 203 may drift due to various reasons, therefore the threshold voltage of the driving module 203 can be detected to obtain the first threshold voltage Vth during the first detection period, and then perform compensation once through the input data signal during the display period, wherein the compensation is usually an external compensation. In addition, during the display period, the threshold voltage of the driving module 203 will also drift during operation, therefore, during the second detection period which is the blank period between adjacent display frames, the threshold voltage of the driving module 203 can be detected to obtain the second threshold voltage Vth', and then the second threshold voltage Vth' can be compensated in the next display frame, during that period, the compensation is usually an internally compensation. Through the combined use of the internal compensation and the external compensation to compensate the threshold voltage drift of the driving module 203 during the entire working cycle, display effect can be significantly improved.

Figure 2:
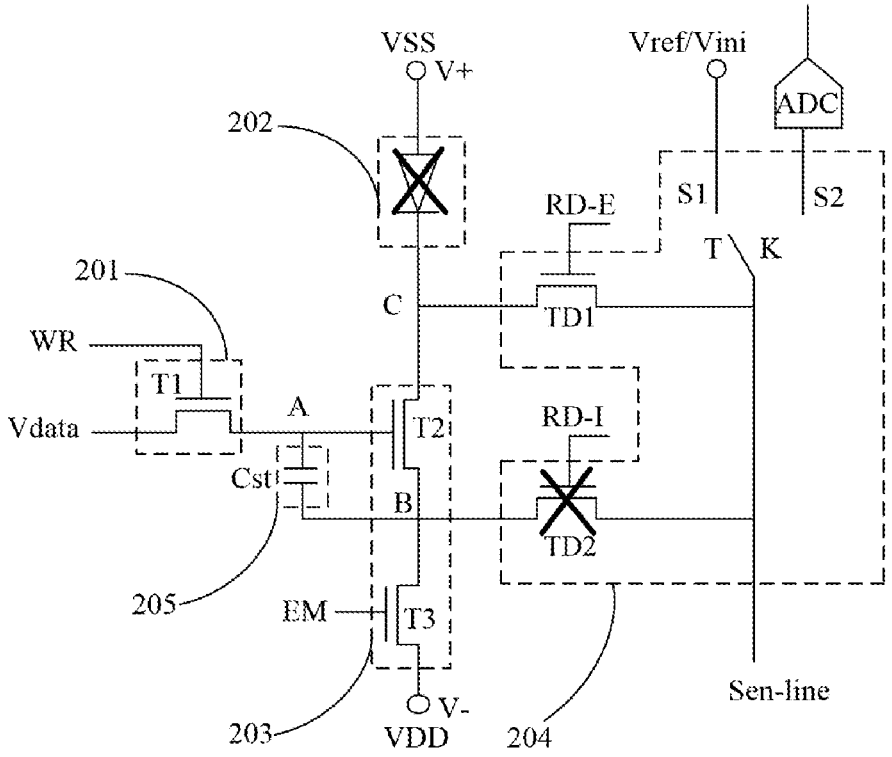
FIG. 2 is a schematic switching diagram of transistors of the pixel driving circuit during a first detection period according to one embodiment of the present disclosure.
Figure 3:
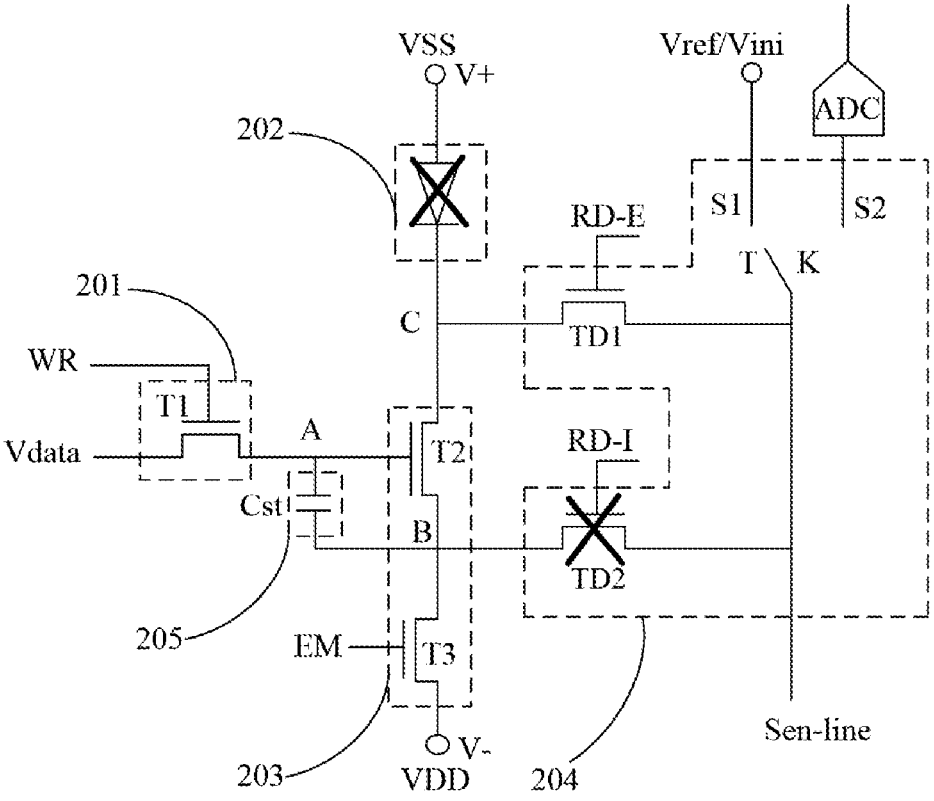
FIG. 3 is a schematic switching diagram of the pixel driving circuit during the first detection period according to one embodiment of the present disclosure.

As shown in FIG. 2, FIG. 2 is a schematic switching diagram of transistors of the pixel driving circuit during the first detection period according to one embodiment of the present disclosure. As shown in FIG. 3, FIG. 3 is a schematic switching diagram of the pixel driving circuit during the first detection period according to pixel driving circuit of the FIG. 2. The first detection period includes an initialization phase t01, a charging phase t02, and a first detection phase t03. During the first detection period, the first power signal input terminal V+ is connected to the low electrical potential power signal VSS, and the second power signal input terminal V− is connected to the high electrical potential power signal VDD.

During the initialization phase t01, the first control signal WR is at the high electrical potential, the first transistor T1 is turned on to input the first data signal Vdata1 which at the high electrical potential to the first point A, the second control signal EM is at a high electrical potential, and the third transistor T3 is turned on, the third control signal RD-E is at the high electrical potential, the first detection transistor TD1 is turned on, the fourth control signal RD-I is at a low electrical potential, the second detection transistor TD2 is turned off, and the movable contact point T of the selection switch K is connected to the first static contact point S1, the control voltage input terminal is inputted a reference voltage signal Vref. At the same time, a gate voltage of the second transistor T2 is Vdata1, and a voltage of the second electrode of the second transistor T2 is Vref.

In the present disclosure, Vg represents the gate voltage of the driver transistor, and Vs represents the source voltage of the driver transistor. Since the first power signal input terminal V+ is connected to the low electrical potential power signal VSS, the second power signal input terminal V− is connected to the high electrical potential power signal VDD, a second electrode of the second transistor T2 serves as a source s, that is, a voltage of the third point C is Vs, and a voltage at the first point A is Vg.

During the charging phase t02, maintaining the first control signal WR at the high electrical potential, turning on the first transistor T1, maintaining the second control signal EM at the high electrical potential, turning on the third transistor T3, maintaining the third control signal RD-E at the high electrical potential, turning on the first detection transistor TD1, maintaining the fourth control signal RD-I at a low electrical potential, turning off the second detection transistor TD2, disconnecting the movable contact point T of the selection switch K from the first static contact point S1 and the second static contact point S2, at this time, continue rising the voltage of the third point C until Vs=Vdata1−Vth.

During the first detection phase t03, maintaining the first control signal WR at the high electrical potential, turning on the first transistor T1, maintaining the second control signal EM at the high electrical potential, turning on the third transistor T3, maintaining the third control signal RD-E at the high electrical potential, turning off the first detection transistor TD1, maintaining the fourth control signal RD-I at a low electrical potential, turning off the second detection transistor TD2, connecting the movable contact point T of the selection switch K to the second static contact point S2, at this time, due to the sensing line sen-line and the third point C are connected, so the voltage on the sensing line sen-line is the same as the voltage on the third point C, the analog-to-digital converter ADC detecting the voltage on the sensing line sen-line and generating the corresponding data to lock save, the detected voltage value Vsamp is the voltage value Vdata1−Vth of the third point C.

After the detection is completed, since the first data signal Vdata1 is a known value, the first threshold voltage Vth can be obtained by subtracting the detected voltage Vdata1−Vth from the known Vdata1, and the obtained first threshold voltage Vth can be stored in the storage module 205, and then the inputted data signal can be adjusted during the display phase after power-on, so as to achieve the compensation of the driver transistor.

During the first detection period, the first power signal input terminal V+ is connected to the low electrical potential power signal VSS, and the second power signal input terminal V− is connected to the high electrical potential power signal VDD, so the anode of the light-emitting device 202 is connected to the low electrical potential power signal VSS. Because the light-emitting device 202 can only be conducted in one direction, when the anode voltage is less than the cathode voltage, the light-emitting device 202 will be immediately turned off, thereby preventing current leakage from the light-emitting device 202 from influencing the detection result of the detection module 204, and improving the detection accuracy, the compensation effect, and the display effect.

Figure 4:
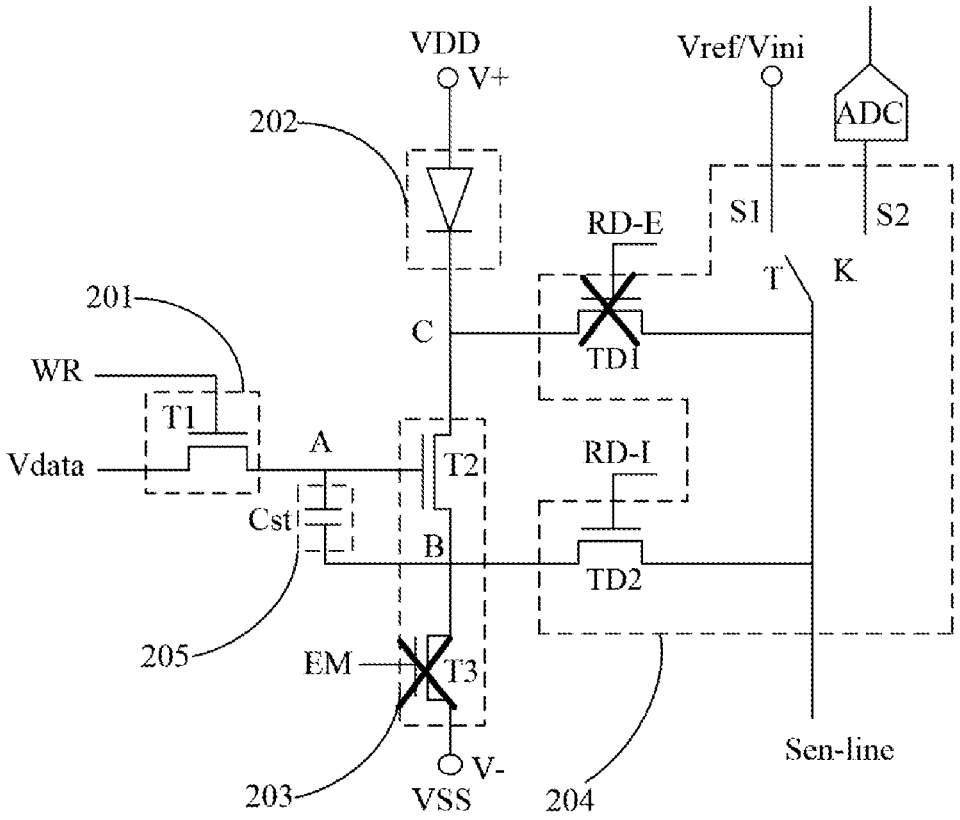
FIG. 4 is a schematic switching diagram of each transistor of a pixel detection circuit during a reset phase of a second detection period according to one embodiment of the present disclosure.
Figure 5:
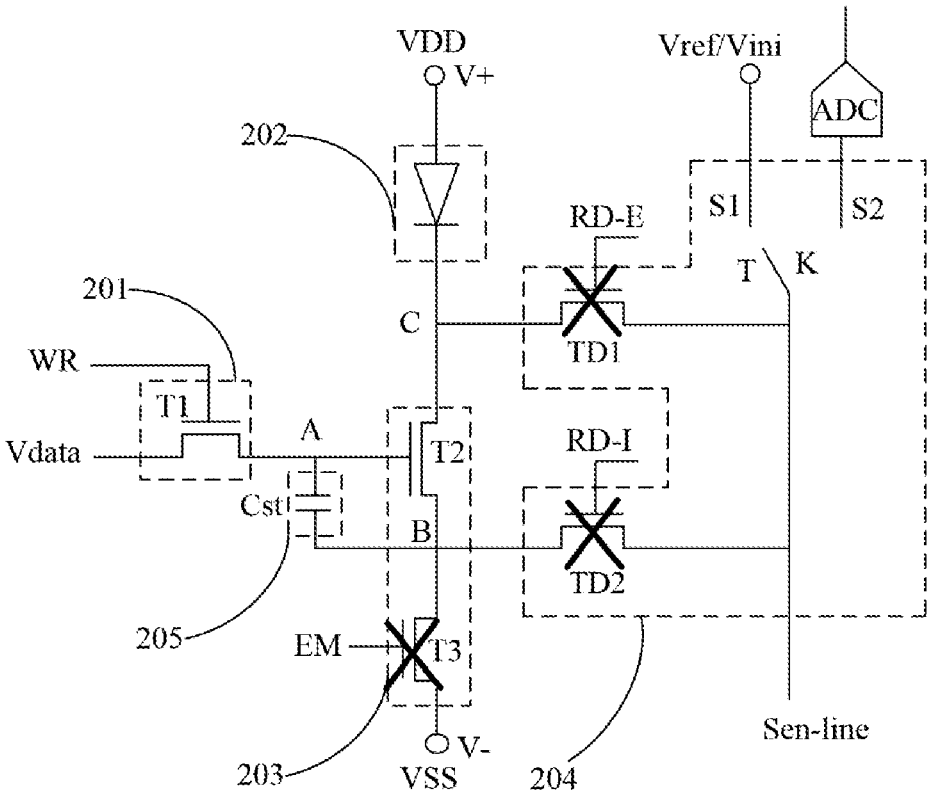
FIG. 5 is a schematic switching diagram of each transistor of the pixel driving circuit during a second detection phase of the second detection period, and a plurality of transistor data writing phase of a display period according to one embodiment of the present disclosure.
Figure 6:
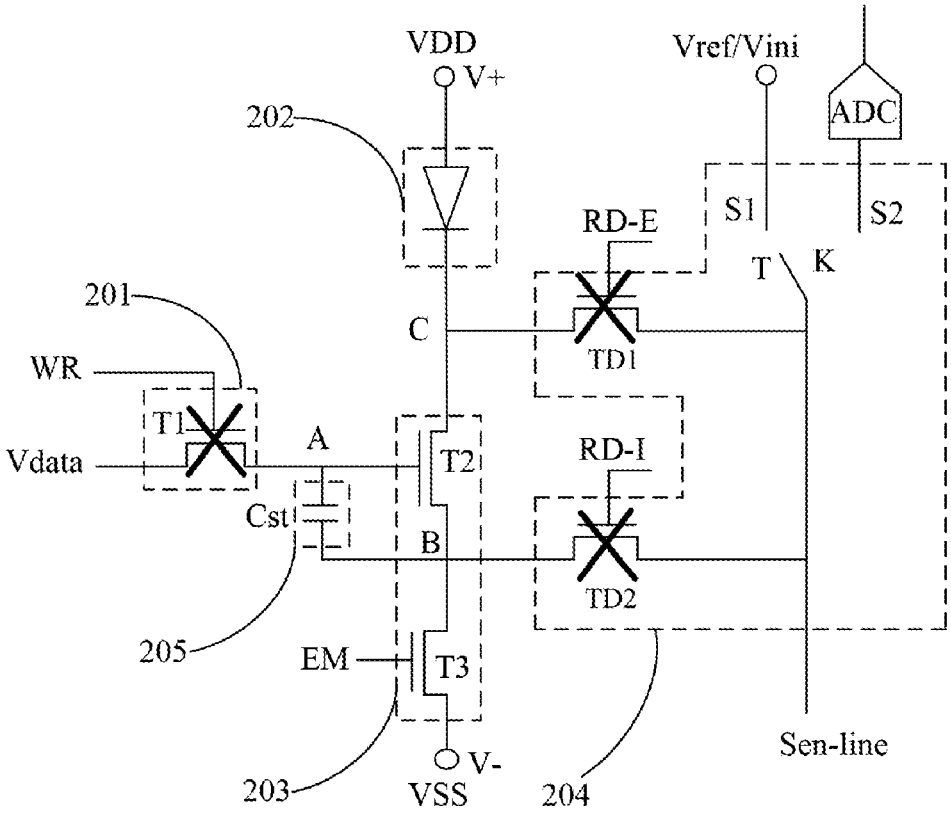
FIG. 6 is a schematic switching diagram of each transistor of the pixel driving circuit during a light-emitting phase according to one embodiment of the present disclosure.
Figure 7:
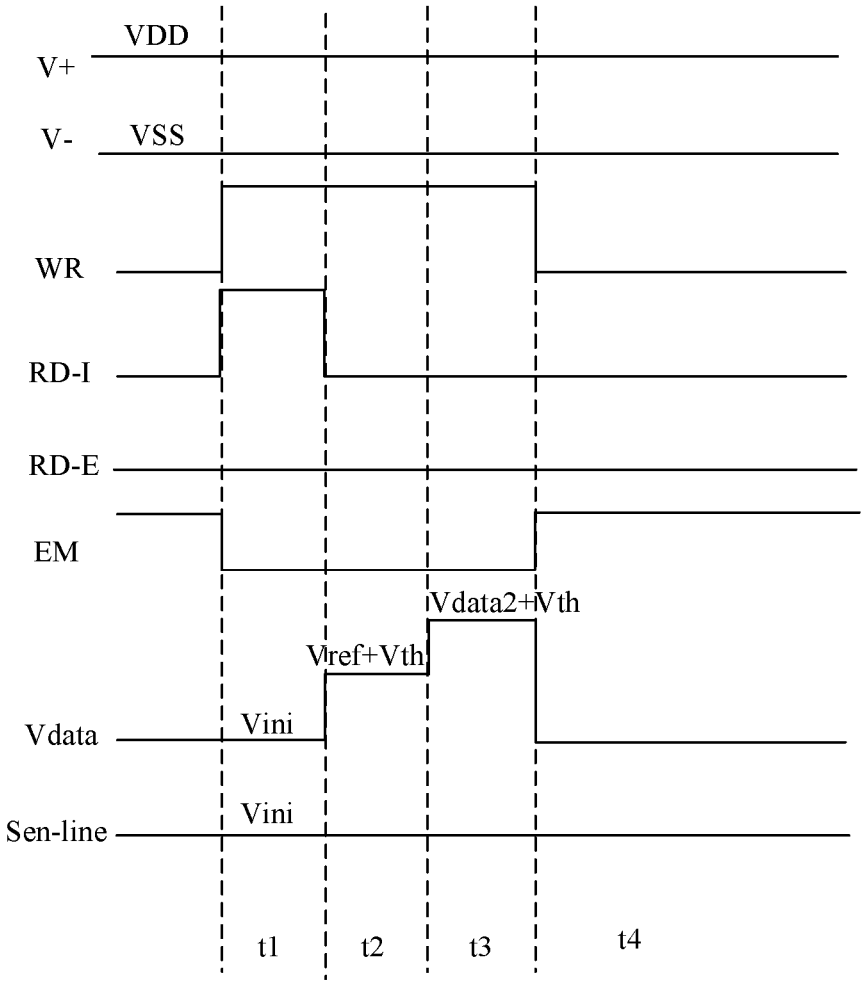
FIG. 7 is a timing diagram of signals of the pixel driving circuit during the second detection period and the display period according to one embodiment of the present disclosure.

As shown in FIG. 4, FIG. 4 is a schematic switching diagram of each transistor of the pixel detection circuit during the reset phase of the second detection period according to one embodiment of the present disclosure. As shown in FIG. 5, FIG. 5 is a schematic switching diagram of each transistor of the pixel driving circuit during the second detection phase of the second detection period, and the plurality of transistor data writing phase of the display period according to one embodiment of the present disclosure. As shown in FIG. 6, FIG. 6 is a schematic switching diagram of each transistor of the pixel driving circuit during a light-emitting phase according to one embodiment of the present disclosure. As shown in FIG. 7, FIG. 7 is a timing diagram of signals of the pixel driving circuit during the second detection period and the display period according to FIG. 4 to FIG. 6. The second detection period includes a reset phase t1 and a second detection phase t2, and the display period is the period of the display frame, including a data writing phase t3 and a light-emitting phase during the reset phase. During the first detection period and the display period, the first power signal input terminal V+ is connected to the high electrical potential power signal VDD, the second power signal input terminal V− is connected to the low electrical potential power signal VSS.

During the reset phase t1, the first control signal WR is at the high electrical potential, turning on the first transistor T1, transmitting the initial voltage signal Vini to the first point A, the second control signal EM is at the low electrical potential, turning off the third transistor T3, the third control signal RD-E is at the low electrical potential, turning off the first detection transistor TD1, the fourth control signal RD-I is at the high electrical potential, turning on the second detection transistor TD2, connecting the movable contact point T of the selector switch K and the first static contact S1, and an initial voltage signal Vini is inputted to the control voltage input terminal. At that time, a gate voltage of the second transistor T2 is Vini, and a voltage of the second electrode of the second transistor T2 is also Vini.

In the present disclosure, Vg represents the gate voltage of the driver transistor, and Vs represents the source voltage of the driver transistor. During the second detection period, the first electrode of the second transistor T2 serves as the source s, that is, the voltage of the second point B is Vs, the voltage of the first point A is Vg, and the voltage difference between the gate and source of the driver transistor Vgs=0.

During the second detection phase t2, maintaining the first control signal WR at the high electrical potential, turning on the first transistor T1, and inputting the compensated reference data signal Vref+Vth to the first point A according to the first threshold voltage Vth. The Vref recited here and the reference voltage signal Vref inputted from the control voltage input terminal during the first detection period are signals input from different input terminals, and the two values may be the same or different. The second control signal EM is maintained at a low electrical potential, the third transistor T3 is turned off, the third control signal RD-E is at a low electrical potential, the first detection transistor TD1 is turned off, the fourth control signal RD-I is at a low electrical potential, and the second detection transistor TD2 is turned off. At this time, the voltage value Vg=Vref+Vth of the first point A, due to the effect of the storage capacitor Cst, the electrical potential Vs of the second point B will gradually increase until the charge is completed when Vgs=Vth+Vth', then, Vth' is stored on both sides of the storage capacitor Cs, at the same time, the electrical potential Vs of the second point B=Vref−Vth'.

During the data writing phase t3, maintaining the first control signal WR at the high electrical potential, turning on the first transistor T1, and inputting a compensated second data signal Vdata2+Vth to the first point A according to the first threshold voltage Vth, maintaining the second control signal EM at the low electrical potential, turning off the third transistor T3, maintaining the third control signal RD-E at a low electrical potential, turning off the first detection transistor TD1, maintaining the fourth control signal RD-I at a low electrical potential, and turning off the second detection transistor TD2. At this time, the electrical potential Vg of the first point A=Vdata2+Vth, relative to the previous phase, the potential of the first point A changes to Vdata2−Vref, due to the common coupling effect of the storage capacitor Cst and the parasitic capacitance Ctft of the second transistor T2, The electrical potential Vs of the second point B=(Vref−Vth')+ΔV, where ΔV=(Vdata−Vref)*Cst/(Cst+Ctft), wherein Cst is the capacitance value of the storage capacitor Cst, and Ctft is the capacitance value of the parasitic capacitance of the second transistor T2, Vgs=Vdata2+Vth−Vref+Vth'−ΔV.

During the light-emitting phase t4, the first control signal WR is at a low electrical potential, the first transistor T1 is turned off, the second control signal EM is at the high electrical potential, the third transistor T3 is turned on, the third control signal RD-E maintains at a low electrical potential, and the first detection transistor TD1 is turned off, the fourth control signal RD-I maintains a low electrical potential, and the second detection transistor TD2 is turned off. Due to the maintenance effect of the storage capacitor Cst, the electrical potential of the first point A is still Vg=Vdata2+Vth, and the voltage difference between the first point A and the second point B is Vgs=Vdata2+Vth−Vref+Vth'−ΔV to drive the light-emitting device 202 emitting light. At the same time, the driving current I flowing through the light-emitting device 202 satisfies the formula:

$$I=K(Vgs-(Vth+Vth'))^2$$

Bringing Vgs=Vdata2+Vth−Vref+Vth'−ΔV into the formula, the result is:

$$I=K(V\text{data2}-V\text{ref}-\Delta V)^2.$$

Wherein, K is an intrinsic conductivity factor driving the thin film transistor, that is, the second transistor T2. Therefore, the current flowing through the light-emitting device 202 is independent of the first threshold voltage Vth and the second threshold voltage Vth' of the second transistor T2. In this way, the influence of the first threshold voltage Vth and the second threshold voltage Vth' by the drift of the driver transistor on the light-emitting device 202 is eliminated, and achieving the compensation of the threshold voltage drift of the display panel during the entire working cycle, so that the brightness of the display panel can be guaranteed.

In the prior art, the cathodes of the light-emitting devices are connected together, and the current flowing through the cathode is controlled by the low electrical potential power signal VSS. As the pixel cathodes are disposed at different positions on the panel, the distances to the power low electrical potential signal input terminal are different. Specifically, the farther away from the low electrical potential power signal VSS input terminal, the smaller the voltage, which causes the power supply voltage drop phenomenon (IR-Drop). On a large-area display panel, IR-Drop will cause a difference between the anode and cathode voltage difference of the light-emitting device at different positions, thereby causing the uneven light emission of the panel and affecting the display quality of images.

In the pixel driving circuit of the present disclosure, the anodes of all the light-emitting devices 202 are connected, and the cathodes of all the light-emitting devices 202 are connected to the output terminal of the driving module 203. During the light-emitting phase t4, the second transistor T2 is in a saturated state, according to the characteristic curve of the TFT, the electrical potential of the third point C is also in a stable state, so that in the pixel driving circuits corresponding to different pixels, the current value of the output terminal of the driving module 203 is within a preset range, so the influence of the power voltage drop dui to the cathodes of the light-emitting devices located at different positions to the display panel is small, thereby improving the brightness uniformity and the display effect of the display panel.

Figure 8:
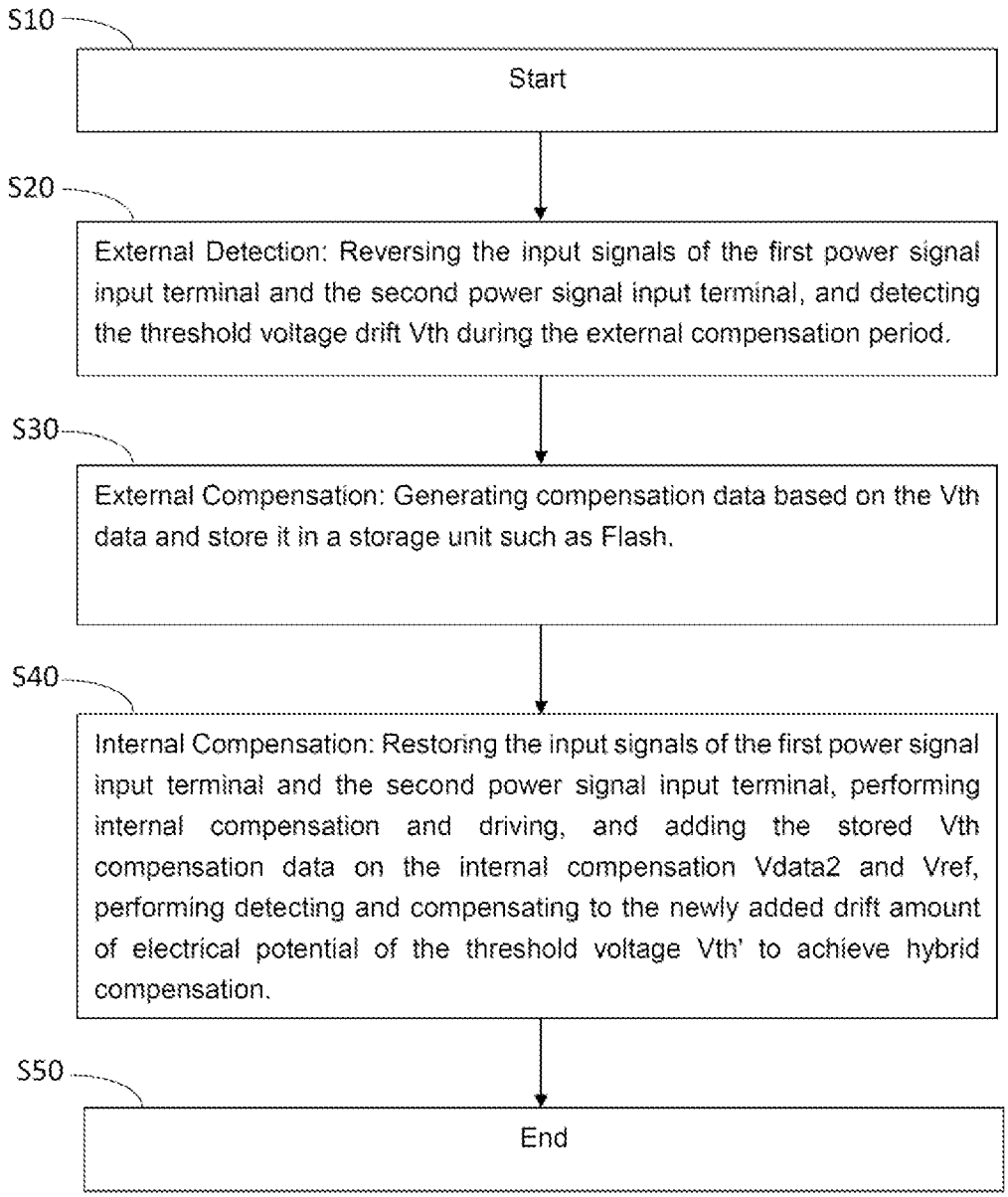
FIG. 8 is a schematic flowchart of comprehensive compensation of the pixel driving circuit according to one embodiment of the present disclosure.

FIG. 8 is a schematic flowchart of comprehensive compensation of a pixel driving circuit according to one embodiment of the present disclosure, which specifically includes the following steps:

S10: Start.

S20: External detection: Reversing the input signals of the first power signal input terminal and the second power signal input terminal, and detecting the threshold voltage drift Vth during the external compensation period.

Under normal circumstances, the first power signal input terminal V+ inputs the high electrical potential power signal VDD, and the second power signal input terminal V− inputs the low electrical potential power signal VSS, during the external detection, that is the first detection period, inverting the input signals of the first power signal input terminal and the second power signal input terminal, the first power signal input terminal V+ inputted the low electrical potential power signal VSS, the second power signal input terminal V− inputted the high electrical potential power signal VDD, therefore, the anode of the light-emitting device 202 is connected to the low electrical potential power signal VSS. Since the light-emitting device 202 can only conduct in one direction, when the anode voltage value is less than the cathode voltage value, the light-emitting device 202 will be immediately turned off, thereby preventing current leakage from the light-emitting device 202 from influencing the detection result of the detection module 204, and improving the detection accuracy, the compensation effect, and the display effect.

In this step, under the control of the third control signal RD-E, the detection module 204 obtains the threshold voltage drift Vth of the external compensation period, that is, the first threshold voltage Vth.

S30: External compensation: Generating compensation data based on the Vth data and store it in a storage unit such as Flash.

In this step, after acquiring the first threshold voltage Vth, the data to be compensated during the display period is calculated according to the value of Vth, and then the data is stored in a storage unit such as Flash.

S40: Internal compensation: Restoring the input signals of the first power signal input terminal and the second power signal input terminal, performing internal compensation and driving, and adding the stored Vth compensation data on the internal compensation Vdata2 and Vref, performing detecting and compensating to the newly added drift amount of electrical potential of the threshold voltage Vth' to achieve hybrid compensation.

In this step, restoring the input signals of the first power signal input terminal and the second power signal input terminal, that is, the first power signal input terminal V+ still inputted the high electrical potential power signal VDD, and the second power signal input terminal V− still inputted the low electrical potential power signal VSS, then, by controlling the electrical potential of each input signal, during the second detection phase of the second detection period, inputting the compensated reference data signal Vref+Vth to the first point, during the data writing phase of the display period, inputting the compensated second data signal Vdata2+Vth to the first point to detect and compensate the newly added threshold voltage drift amount Vth', that is, the second threshold voltage Vth', thereby achieving comprehensive compensation with external and internal compensation.

S50: End.

It can be known from the above embodiments that the pixel driving circuit of the present disclosure detects the threshold voltage of the driving module 203 in the first detection period and the second detection period, and performs comprehensive compensation during the display period, thereby achieving better compensation effect. In the pixel driving circuit of the present disclosure, anodes of all the light-emitting device 202 are connected, cathodes of all the light-emitting device 202 are connected to the output terminal of the driving module 203, and in the light-emitting phase of the display period, voltage values of the output terminals of the driving module 203 are all within a preset range in the pixel driving circuits corresponding to different sub-pixels. That is, the voltage values of the cathode of the light-emitting device 202 at different positions of the display panel are within the preset range, so each light-emitting device 202 can be less affected by the power supply voltage drop, thereby improving the brightness uniformity of the display panel. Moreover, during the first detection period, the anode of the light-emitting device 202 is connected to the low electrical potential power signal VSS, thereby turning off the light-emitting device 202 directly, preventing electrical leakage of light-emitting device 202 to the detection module 204, thereby improving the detection accuracy.

The present disclosure also provides a display panel including the pixel driving circuit described in any of the above embodiments. By using the pixel driving circuit provided by the embodiments of the present disclosure, the cathode voltage of each light-emitting device can be less affected by the voltage drop of the power supply, thereby improving the brightness uniformity and the display effect of the display panel.

According to the above embodiments:

Embodiments of the present disclosure provide a pixel driving circuit and a display panel, wherein the pixel driving circuit includes a data signal input module, a light-emitting device, a driving module, a detection module, and a storage module. The data signal input module is configured to input a first data signal to a first point under control of a first control signal in a first detection period, wherein the first detection period is a non-display period before turning on or after turning off; an anode of the light-emitting device is connected to a first power signal input terminal; a first input terminal of the driving module is connected to the data signal input module through the first point, a second input terminal of the driving module is connected to a second power signal input terminal, and an output terminal of the driving module is connected to a cathode of the light-emitting device, wherein the driving module is configured to drive the light-emitting device to emit light under control of a second control signal and an electric potential of the first point. The detection module is connected to a third input terminal of the driving module through a second point, connected to the output terminal of the driving module through a third point, configured to detect a first threshold voltage of the driving module under a control of a third control signal during the first detection period, and configured to detect a second threshold voltage of the driving module under a control of a fourth control signal during a second detection period, wherein the second detection period is a blank period between adjacent display frames. The storage module is connected to the driving module through the first point and the second point, and configured to store the first threshold voltage and the second threshold voltage of the driving module, wherein the data signal input module is further configured to input a compensated second data signal to the first point during a data writing phase of a display period according to the first threshold voltage detected by the detection module. The driving module is further configured to input a driving current to the light-emitting device during a light-emitting phase of the display period according to the second data signal and the second threshold voltage detected by the detection module, wherein the driving current is independent of values of the first threshold voltage and the second threshold voltage, and wherein during the first detection period, the first power signal input terminal is connected to a low electrical potential power signal, and the second power signal input terminal is connected to the high electrical potential power signal, during the second detection period and the display period, the first power signal input terminal is connected to the high electrical potential power signal, and the second power signal input terminal is connected to the low electrical potential power signal, and in the light-emitting phase of the display period, voltage values of the output terminals of the driving modules are all within a preset range in the pixel driving circuits corresponding to different sub-pixels. In the pixel driving circuit of the present disclosure, anodes of all the light-emitting device are connected, cathodes of all the light-emitting device are connected to the output terminal of the driving module, and in the light-emitting phase of the display period, voltage values of the output terminals of the driving modules are all within a preset range in the pixel driving circuits corresponding to different sub-pixels. That is, the voltage values of the cathode of the light-emitting device at different positions of the display panel are within the preset range, so each light-emitting device can be less affected by the power supply voltage drop, therefore improving brightness uniformity of the display panel. Moreover, during the first detection period, the anode of the light-emitting device is connected to the low electrical potential power signal, thereby turning off the light-emitting device directly, preventing electrical leakage of the light-emitting device to the detection module, thereby improving detection accuracy.

In the above embodiments, the description of each embodiment has its own emphasis. For a part that is not detailed in an embodiment, the related descriptions of other embodiments can be referred.

The pixel driving circuit and the display panel of the embodiments of the present disclosure are described in detail above. Specific embodiments are used to explain the principle and implementation of the present disclosure. The above description only the preferred embodiments of the present disclosure. It should be noted that for those of ordinary skill in the art without departing from the principles of the present disclosure, several improvements and adjustments can be made, and these improvements and adjustments should also be considered in the protection scope of the present disclosure.

What is claimed is:

1. A pixel driving circuit, comprising:

a data signal input module configured to input a first data signal to a first point under control of a first control signal in a first detection period, wherein the first detection period is a non-display period before turning on or after turning off;

a light-emitting device, wherein an anode of the light-emitting device is connected to a first power signal input terminal;

a driving module, wherein a first input terminal of the driving module is connected to the data signal input module through the first point, a second input terminal of the driving module is connected to a second power signal input terminal, and an output terminal of the driving module is connected to a cathode of the light-emitting device, and wherein the driving module is configured to drive the light-emitting device to emit light under control of a second control signal and an electric potential of the first point;

a detection module connected to a third input terminal of the driving module through a second point, connected to the output terminal of the driving module through a third point, configured to detect a first threshold voltage of the driving module under control of a third control signal during the first detection period, and configured to detect a second threshold voltage of the driving module under control of a fourth control signal during a second detection period, wherein the second detection period is a blank period between adjacent display frames, wherein the detection module comprises a first detection transistor, a second detection transistor, a sensing line, and a selection switch, a gate of the first detection transistor is connected to the third control signal, a first electrode of the first detection transistor is connected to the sensing line, a second electrode of the first detection transistor is connected to the third point, a gate of the second detection transistor is connected to the fourth control signal, a first electrode of the second detection transistor is connected to the sensing line, a second electrode of the second detection transistor is connected to the second point, a movable contact point of the selection switch is connected to the sensing line, a first static contact point of the selection switch is connected to a control voltage input terminal, and a second static contact point of the selection switch is connected to an analog-to-digital converter; and a storage module connected to the driving module through the first point and the second point, and configured to store the first threshold voltage and the second threshold voltage of the driving module;

wherein the data signal input module is further configured to input a compensated second data signal to the first point during a data writing phase of a display period according to the first threshold voltage detected by the detection module, the driving module is further configured to input a driving current to the light-emitting device during a light-emitting phase of the display period according to the second data signal and the second threshold voltage detected by the detection module, wherein the driving current is independent of values of the first threshold voltage and the second threshold voltage, and wherein during the first detection period, the first power signal input terminal is connected to a low electrical potential power signal, and the second power signal input terminal is connected to a high electrical potential power signal, during the second detection period and the display period, the first power signal input terminal is connected to the high electrical potential power signal, and the second power signal input terminal is connected to the low electrical potential power signal, and in the light-emitting phase of the display period, voltage values of the output terminal of the driving module are all within a preset range in the pixel driving circuits corresponding to different sub-pixels; and wherein the first detection period comprises an initialization phase, a charging phase, and a first detection phase, and the detection module is configured to control the movable contact point of the selection switch to be connected to the first static contact point during the initialization phase, control the movable contact point of the selection switch to be disconnected from both the first static contact point and the second static contact point during the charging phase, and control the movable contact point of the selection switch connected to the second static contact point during the first detection phase.

2. The pixel driving circuit as claimed in claim 1, wherein the data signal input module comprises a first transistor, a gate of the first transistor is connected to the first control signal, a first electrode of the first transistor is connected to a data line, and a second electrode of the first transistor is connected to the first point.

3. The pixel driving circuit as claimed in claim 2, wherein the light-emitting device comprises a light-emitting diode or an organic light-emitting diode.

4. The pixel driving circuit as claimed in claim 3, wherein the driving module comprises a second transistor and a third transistor, a gate of the second transistor is connected to the first point, a first electrode of the second transistor and a second electrode of the third transistor are connected to the second point, a second electrode of the second transistor and the cathode of the light-emitting device are connected to the third point, a gate of the third transistor is connected to the second control signal, and a first electrode of the third transistor is connected to the second power signal input terminal.

5. The pixel driving circuit as claimed in claim 1, wherein the storage module comprises a storage capacitor, a first plate of the storage capacitor is connected to the first point, and a second plate of the storage capacitor is connected to the second point.

6. The pixel driving circuit as claimed in claim 5, wherein during the first detection period, the third control signal is at a high electrical potential and the fourth control signal is at a low electrical potential.

7. The pixel driving circuit as claimed in claim 5, wherein the second detection period comprises a reset phase and a second detection phase, during the reset phase, the third control signal is at a low electrical potential and the fourth control signal is at a high electrical potential, and during the second detection phase, the third control signal and the fourth control signal are both at the low electrical potential.

8. The pixel driving circuit as claimed in claim 7, wherein the detection module is configured to control the movable contact point of the selection switch to be connected to the first static contact point during the reset phase.

9. The pixel driving circuit as claimed in claim 8, wherein during the reset phase, an initial voltage signal is inputted to the control voltage input terminal.

10. The pixel driving circuit as claimed in claim 7, wherein the data signal input module is configured to input a compensated reference data signal to the first point according to the first threshold voltage detected by the detection module during the second detection phase.

11. The pixel driving circuit as claimed in claim 5, wherein during the display period, the third control signal and the fourth control signal are both at a low electrical potential.

12. The pixel driving circuit as claimed in claim 1, wherein during the initialization phase, the control voltage input terminal is inputted a reference voltage signal.

13. A display panel comprising a pixel driving circuit, wherein the pixel driving circuit comprises:

a data signal input module configured to input a first data signal to a first point under control of a first control signal in a first detection period, wherein first detection period is a non-display period before turning on or after turning off;

a light-emitting device, wherein an anode of the light-emitting device is connected to a first power signal input terminal;

a driving module, wherein a first input terminal of the driving module is connected to the data signal input module through the first point, a second input terminal of the driving module is connected to a second power signal input terminal, and an output terminal of the driving module is connected to a cathode of the light-emitting device, and wherein the driving module is configured to drive the light-emitting device to emit light under control of a second control signal and an electric potential of the first point;

a detection module connected to a third input terminal of the driving module through a second point, connected to the output terminal of the driving module through a third point, configured to detect a first threshold voltage of the driving module under control of a third control signal during the first detection period, and configured to detect a second threshold voltage of the driving module under control of a fourth control signal during a second detection period, wherein the second detection period is a blank period between adjacent display frames, wherein the detection module comprises a first detection transistor, a second detection transistor, a sensing line, and a selection switch, a gate of the first detection transistor is connected to the third control signal, a first electrode of the first detection transistor is connected to the sensing line, a second electrode of the first detection transistor is connected to the third point, a gate of the second detection transistor is connected to the fourth control signal, a first electrode of the second detection transistor is connected to the sensing line, a second electrode of the second detection transistor is connected to the second point, a movable contact point of the selection switch is connected to the sensing line, a first static contact point of the selection switch is connected to a control voltage input terminal, and a second static contact point of the selection switch is connected to an analog-to-digital converter; and a storage module connected to the driving module through the first point and the second point, and configured to store the first threshold voltage and the second threshold voltage of the driving module;

wherein the data signal input module is further configured to input a compensated second data signal to the first point during a data writing phase of a display period according to the first threshold voltage detected by the detection module, the driving module is further configured to input a driving current to the light-emitting device during a light-emitting phase of the display period according to the second data signal and the second threshold voltage detected by the detection module, wherein the driving current is independent of values of the first threshold voltage and the second threshold voltage, and wherein during the first detection period, the first power signal input terminal is connected to a low electrical potential power signal, and the second power signal input terminal is connected to a high electrical potential power signal, during the second detection period and the display period, the first power signal input terminal is connected to the high electrical potential power signal, and the second power signal input terminal is connected to the low electrical potential power signal, and in the light-emitting phase of the display period, voltage values of the output terminal of the driving module are all within a preset range in pixel driving circuits corresponding to different sub-pixels; and wherein the first detection period comprises an initialization phase, a charging phase, and a first detection phase, and the detection module is configured to control the movable contact point of the selection switch to be connected to the first static contact point during the initialization phase, control the movable contact point of the selection switch to be disconnected from both the first static contact point and the second static contact point during the charging phase, and control the movable contact point of the selection switch connected to the second static contact point during the first detection phase.

14. The display panel as claimed in claim 13, wherein the data signal input module comprises a first transistor, a gate of the first transistor is connected to the first control signal, a first electrode of the first transistor is connected to a data line, and a second electrode of the first transistor is connected to the first point.

15. The display panel as claimed in claim 14, wherein the light-emitting device comprises a light-emitting diode or an organic light-emitting diode.

16. The display panel as claimed in claim 15, wherein the driving module comprises a second transistor and a third transistor, a gate of the second transistor is connected to the first point, a first electrode of the second transistor and a second electrode of the third transistor are connected to the second point, a second electrode of the second transistor and the cathode of the light-emitting device are connected to the third point, a gate of the third transistor is connected to the second control signal, and a first electrode of the third transistor is connected to the second power signal input terminal.

17. The display panel as claimed in claim 13, wherein the storage module comprises a storage capacitor, a first plate of the storage capacitor is connected to the first point, and a second plate of the storage capacitor is connected to the second point.

* * * * *